US009412299B2

(12) United States Patent
Miyazawa et al.

(10) Patent No.: US 9,412,299 B2
(45) Date of Patent: Aug. 9, 2016

(54) DRIVE CIRCUIT, DISPLAY DEVICE, AND DRIVE METHOD

(71) Applicant: Japan Display Inc., Tokyo (JP)

(72) Inventors: Toshio Miyazawa, Tokyo (JP); Mitsuhide Miyamoto, Tokyo (JP)

(73) Assignee: JAPAN DISPLAY INC., Tokyo (JP)

( * ) Notice: Subject to any disclaimer, the term of this patent is extended or adjusted under 35 U.S.C. 154(b) by 6 days.

(21) Appl. No.: 14/474,441

(22) Filed: Sep. 2, 2014

(65) Prior Publication Data

US 2015/0061538 A1 Mar. 5, 2015

(30) Foreign Application Priority Data

Sep. 2, 2013 (JP) ..... 2013-181387

(51) Int. Cl.
*G09G 3/32* (2016.01)

(52) U.S. Cl.
CPC ..... *G09G 3/3233* (2013.01); *G09G 2300/0814* (2013.01); *G09G 2300/0819* (2013.01); *G09G 2300/0842* (2013.01); *G09G 2300/0861* (2013.01); *G09G 2320/0214* (2013.01)

(58) Field of Classification Search
CPC . G09G 3/3233; G09G 3/3291; G09G 3/3258; G09G 2300/0866
USPC ..... 345/204, 207, 211, 212, 213, 214, 55, 345/76, 77, 82, 83, 84, 99, 100, 102
See application file for complete search history.

(56) References Cited

U.S. PATENT DOCUMENTS

2005/0017934 A1 1/2005 Chung et al.
2007/0018917 A1* 1/2007 Miyazawa ..... G09G 3/3233 345/76
2009/0273617 A1* 11/2009 Tanikame ..... G09G 3/3233 345/690

FOREIGN PATENT DOCUMENTS

JP 4391857 B 10/2009

* cited by examiner

*Primary Examiner* — Tuyet Vo
(74) *Attorney, Agent, or Firm* — TYPHA IP LLC

(57) ABSTRACT

A drive circuit for a light emitting element which can correct a threshold voltage of a drive transistor between two reference voltages without a reset power supply. The drive circuit includes a light emitting element, a drive transistor for controlling an amount of current, a first switching element that is arranged between the light emitting element and the drive transistor, a second switching element that is arranged between the drive transistor and the second reference voltage, a third switching element that is arranged between a gate, and one of a source and a drain of the drive transistor, a fourth switching element that is connected to the other of the source and the drain of the drive transistor, and controls input of signal voltage, and a first capacitor connected to the gate of the drive transistor.

13 Claims, 11 Drawing Sheets

DRIVE CIRCUIT, DISPLAY DEVICE, AND DRIVE METHOD

CROSS-REFERENCE TO RELATED APPLICATION

The present application claims priority from Japanese application JP 2013-181387, filed on Sep. 2, 2013, the content of which is hereby incorporated by reference into this application.

BACKGROUND OF THE INVENTION

1. Field of the Invention

The present invention relates to a drive circuit for a light emitting element, and a display device having the drive circuit.

2. Description of the Related Art

A light emitting element such as an organic EL element (OLED) is used for image display. The light emitting element conducts the light emitting operation while controlling the amount of current flowing into the light emitting element. A drive circuit that conducts light emitting drive of the light emitting element includes a drive transistor. The drive transistor has a threshold voltage, and the threshold voltage is varied depending on the manufactured drive transistor. In particular, when the drive transistor is formed of a low-temperature polysilicon thin film transistor (TFT), a variation in the threshold voltage of the drive transistor occurs due to a crystal variation of polysilicon formed in a process of subjecting a semiconductor layer to laser annealing. As a result, a display quality of the light emitting element is degraded due to the threshold voltage of the drive transistor, and the variation in the threshold voltage. For that reason, there is a need to correct a voltage to be applied to a gate of the drive transistor when the light emitting element emits light according to the threshold voltage of the drive transistor from the viewpoint of suppressing the degradation of the display quality. For example, Japanese Patent No. 4391857 discloses a pixel circuit in an organic electroluminescent display device having a function of correcting the threshold voltage (threshold voltage) of the drive transistor.

SUMMARY OF THE INVENTION

In the pixel circuit disclosed in Japanese Patent No. 4391857, the drive transistor (transistor T31) and the light emitting element (EL element EL11) are arranged between the supply voltage VDD and the ground voltage VSS, and a voltage to be applied to the gate of the drive transistor is controlled by a voltage across the capacitor C11. In the above pixel circuit, reset operation (initialization operation) of initializing a voltage (data signal stored in the capacitor C11) to be applied to the gate of the drive transistor is required before the operation (data programming operation) of writing a signal voltage according to display data. The pixel circuit disclosed in Japanese Patent No. 4391857 is connected to the reset power supply (initialization voltage Vinti). One terminal of the capacitor C11 is connected to the reset power supply (initialization voltage Vinti) in the reset operation (initialization operation), to thereby initialize the data signal stored in the capacitor C11. In the drive circuit that can correct the threshold voltage of the drive transistor as described above, the reset power supply is required for resetting the voltage to be applied to the gate of the drive transistor. Also, there is a drive circuit pertaining to a related art requiring no reset power supply. In the drive circuit of this type, a drive transistor and a light emitting element are arranged between a positive power supply and a negative power supply, and any one of the positive power supply and the negative power supply is changed in the reset operation. That is, instead of the deletion of the reset power supply, any one of the positive power supply and the negative power supply is not kept at a constant voltage, but needs to be changed in voltage under control. When the reset power supply is used for the reset operation, a dedicated wiring space of the reset power supply needs to be ensured in the pixel circuit, resulting in a disadvantage to higher definition. Also, when a voltage across the positive power supply or the negative power supply is changed, a power supply circuit for supplying the voltage, and a control circuit for controlling the voltage change are required. This leads to an increase in the circuit, and also the prevention of power saving, likewise.

The present invention has been made in view of the above problem, and therefore aims at providing a drive circuit for a light emitting element which can correct a threshold voltage of a drive transistor with the use of two reference voltages without requiring a reset power supply.

(1) In order to solve the above problem, according to the present invention, there is provided a drive circuit including: a first line that is connected to a first reference voltage; a second line that is connected to a second reference voltage higher than the first reference voltage; a light emitting element that is arranged between the first line and the second line, and emits a light by allowing a current to flow therein; a drive transistor that is arranged between the light emitting element and the second line, for controlling the amount of current flowing into the light emitting element; a first switching element that is arranged between the light emitting element and the drive transistor; a second switching element that is arranged between the drive transistor and the second line; a third switching element that is arranged between a gate of the drive transistor, and one of a source and a drain of the drive transistor; a fourth switching element that is connected between the other of the source and the drain of the drive transistor, and controls an input of a signal voltage; and a first capacitor having one end connected to the gate of the drive transistor.

(2) In the drive circuit according to the above item (1), the first capacitor may have the other end connected to a constant voltage.

(3) In the drive circuit according to the above item (2), the first capacitor may have the other end connected to the second reference voltage.

(4) In the drive circuit according to any one of the above items (1) to (3), one of the first switching element and the third switching element maybe a p-type transistor, and the other thereof may be an n-type transistor.

(5) In the drive circuit according to any one of the above items (1) to (4), one of the second switching element and the fourth switching element maybe a p-type transistor, and the other thereof may be an n-type transistor.

(6) In the drive circuit according to the above item (3), both of a gate of the first switching element and a gate of the third switching element may be connected to a first control line.

(7) In the drive circuit according to the above item (5), both of a gate of the second switching element and a gate of the fourth switching element maybe connected to a second control line.

(8) The drive circuit according to any one of the above items (1) to (7) further may include: a second capacitor that is arranged between the gate of the drive transistor, and one of the source and the drain of the drive transistor.

(9) In the drive circuit according to any one of the above items (1) to (8), the third switching element may be a transistor having a multi-gate structure.

(10) In the drive circuit according to any one of the above items (1) to (9), the fourth switching element may be a transistor having a multi-gate structure.

(11) According to the present invention, there may be provided a display device including a display unit in which plural drive circuits according to any one of the above items (1) to (10) are arrayed.

(12) According to the present invention, there is provided a drive method for a drive circuit including: a first line that is connected to a first reference voltage; a second line that is connected to a second reference voltage higher than the first reference voltage; a light emitting element that is arranged between the first line and the second line, and emits a light by allowing a current to flow therein; a drive transistor that is arranged between the light emitting element and the second line, for controlling the amount of current flowing into the light emitting element; a first switching element that is arranged between the light emitting element and the drive transistor; a second switching element that is arranged between the drive transistor and the second line; a third switching element that is arranged between a gate of the drive transistor, and one of a source and a drain of the drive transistor; a fourth switching element that is connected between the other of the source and the drain of the drive transistor, and controls an input of a signal voltage; and a first capacitor having one end connected to the gate of the drive transistor, the drive method including: a first period in which the first switching element and the second switching element are in an on-state, and the third switching element and the fourth switching element are in an off-state; a second period in which the first switching element is in the off-state, and the third switching element is in the on-state; a third period in which the second switching element is in the off-state, the first switching element is in the off-state, and the third switching element is in the on-state; and a fourth period in which both of the third switching element and the fourth switching element are in the off-state, and both of the first switching element and the second switching element are in the on-state.

According to the present invention, there is provided the drive circuit for the light emitting element which can correct a threshold voltage of a drive transistor with the use of two reference voltages without requiring a reset power supply.

DETAILED DESCRIPTION OF THE INVENTION

Figure 1:
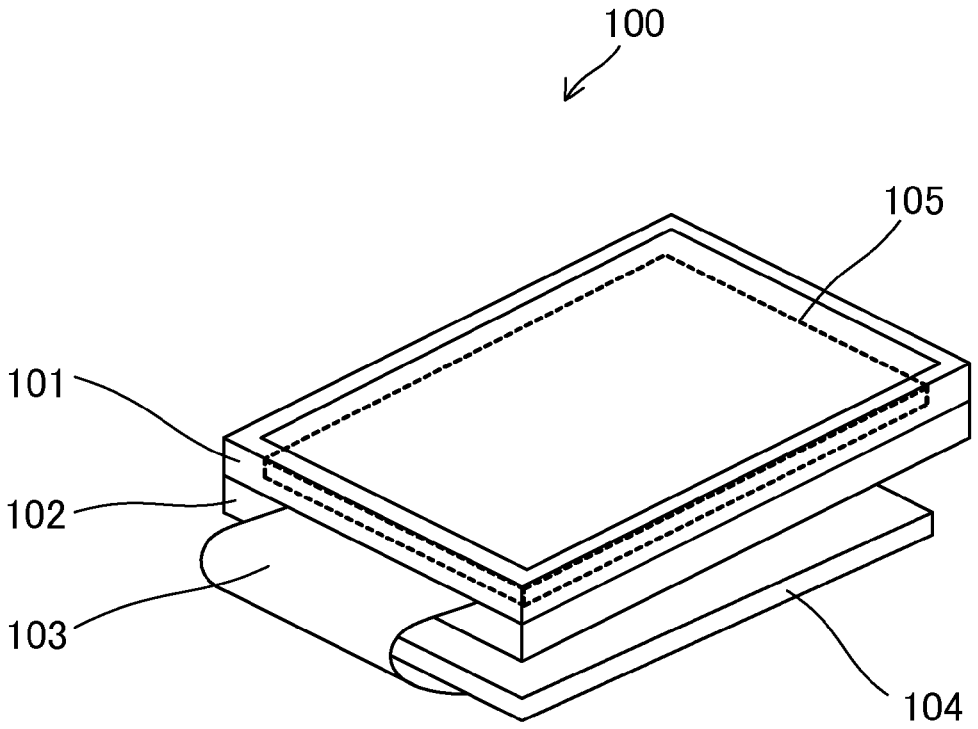
FIG. 1 is a diagram illustrating a display device according to a first embodiment of the present invention.

Hereinafter, a description will be given of embodiments of the present invention specifically and in detail with reference to the accompanying drawings. In all of the drawings for illustrating the embodiments, members having the same functions are indicated by identical symbols, and a repetitive description thereof will be omitted. Also, the drawings described below illustrate examples of the embodiments, and sizes in the drawings do not always match scales illustrated in the embodiments.

First Embodiment

FIG. 1 is a diagram illustrating a display device according to a first embodiment of the present invention. The display device according to this embodiment is an organic EL display device 100 using organic EL elements as light emitting elements. As illustrated in FIG. 1, the organic EL display device 100 includes an upper frame 101 and a lower frame 102 that fix a TFT substrate 105 having an organic EL panel interposed therebetween, a circuit board 104 having a circuit element for generating information to be displayed, and a flexible substrate 103 (FPC: flexible printed circuit) that transmits information on RGB generated in the circuit board 104 to the TFT substrate 105.

Figure 2:
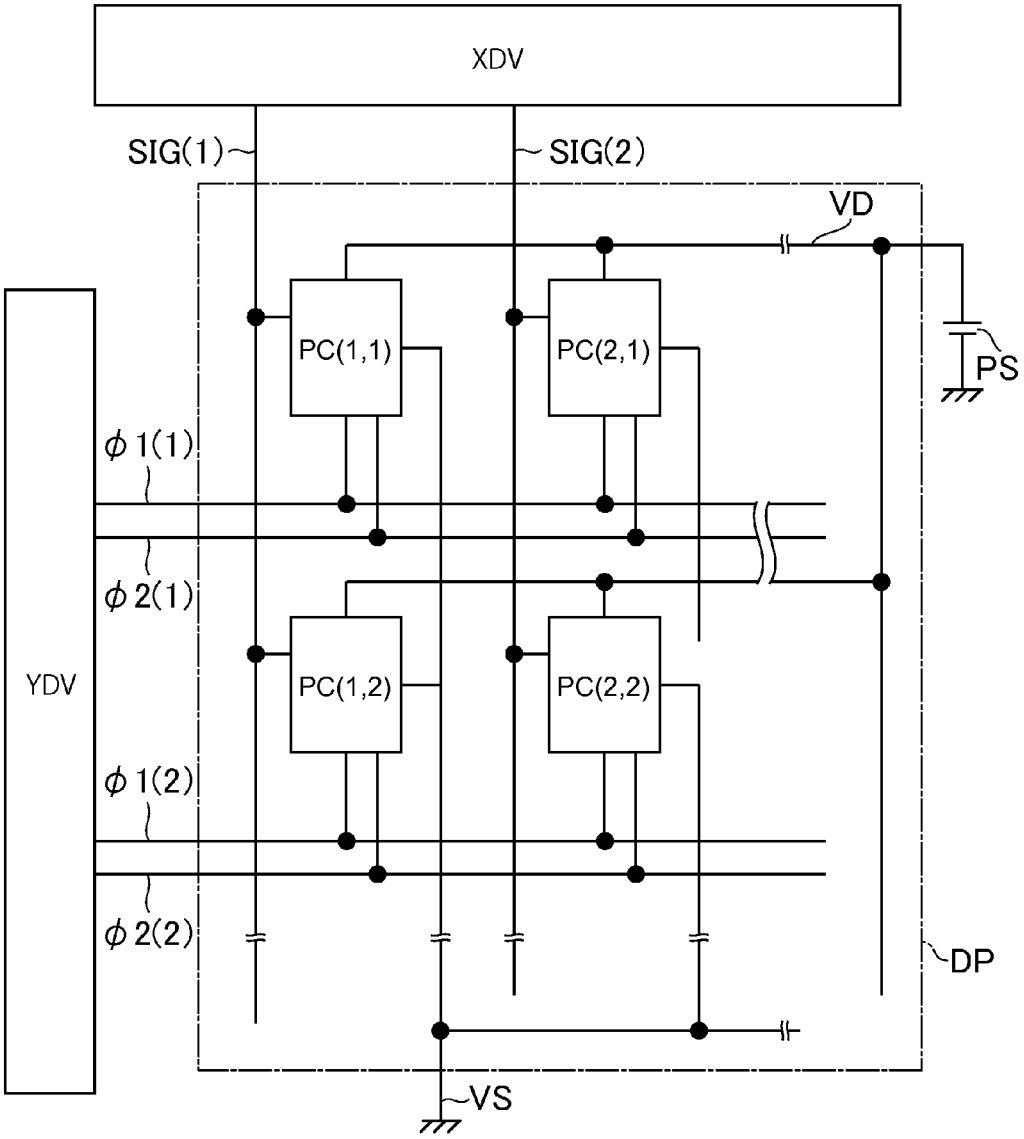
FIG. 2 is a diagram illustrating an equivalent circuit of the display device according to the first embodiment of the present invention.

FIG. 2 is a diagram illustrating an equivalent circuit of the display device according to the embodiment. FIG. 2 particularly illustrates the organic EL panel in the organic EL display device 100. The organic EL panel includes plural signal lines SIG that are extended in a longitudinal direction in the figure, and also arranged side by side in a lateral direction, plural first control lines ϕ1 that are extended in the lateral direction in the figure, and also arranged side by side in the longitudinal direction, plural second control lines ϕ2 that are arranged side by side with the respective first control lines ϕ1, plural pixel circuits PC that are arranged in a matrix corresponding to intersections of the signal lines SIG and the first control lines ϕ1 (second control lines ϕ2), a signal line drive circuit XDV, and a scanning line drive circuit YDV. The signal lines SIG have respective upper ends connected to the signal line drive circuit XDV. The first control lines ϕ1 and the second control lines ϕ2 are connected to the scanning line drive circuit YDV. The plural pixel circuits PC configure a display area DP. The signal line drive circuit XDV and the scanning line drive circuit YDV drive the respective pixel circuits PC in cooperation with each other.

A first power supply line connected to a ground voltage GND is maintained at a first reference voltage $V_S$. Also, a voltage source PS supplies a second reference voltage $V_D$ to a second power supply line connected to the voltage source PS, and the second reference voltage $V_D$ is higher than the first reference voltage $V_S$. The first power supply line and the second power supply line are connected to the respective pixel circuits PC. That is, in this embodiment, the first reference voltage $V_S$ is a ground voltage, but is not limited to this voltage. Also, FIG. 2 illustrates only four pixel circuits PC of 2×2. However, the pixel circuits PC of the number corresponding to a display resolution are actually present. In general, a pixel circuit located on an n-th row and an m-th column is represented by PC (m, n). For example, a pixel circuit located in the upper left is represented by PC (1, 1). Also, a signal line connected to a pixel circuit on the m-th column is represented by SIG (m), and the first control line ϕ1 and the second control line ϕ2 which are connected to the pixel circuit PC on the n-th row are represented by ϕ1 (n) and ϕ2 (n), respectively.

Figure 3:
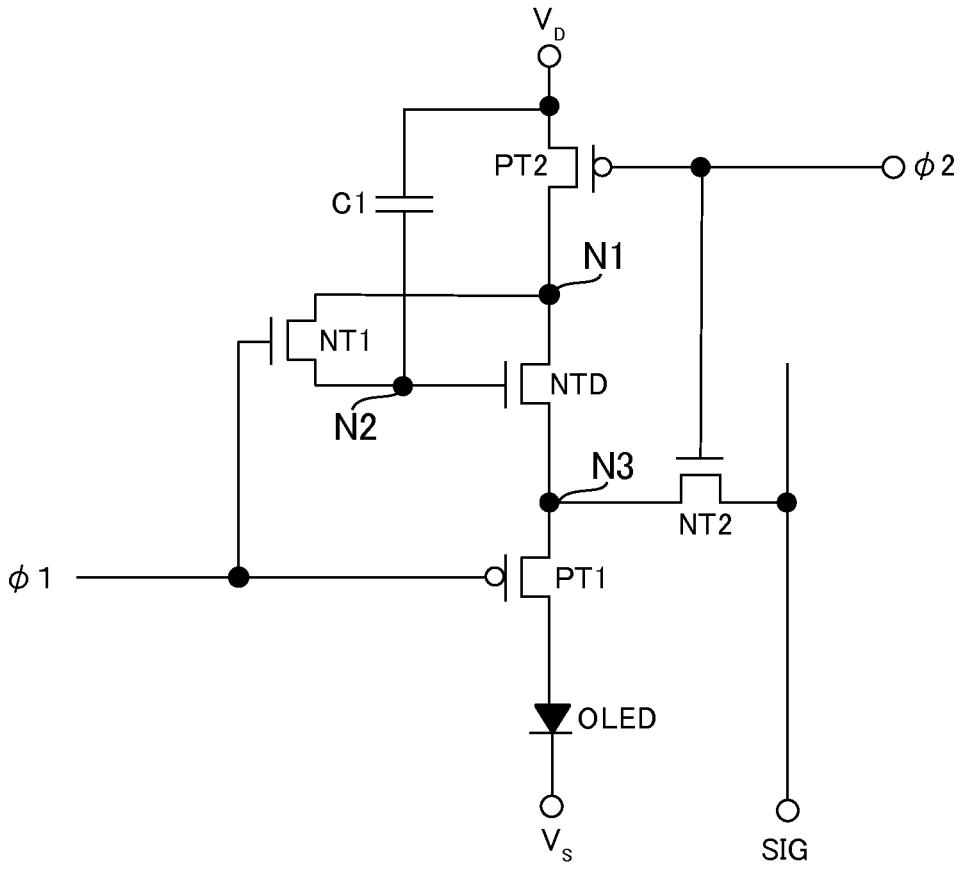
FIG. 3 is a circuit diagram of a drive circuit according to the first embodiment of the present invention.

FIG. 3 is a circuit diagram of a drive circuit according to the embodiment. The drive circuit illustrated in FIG. 3 is a drive circuit of an organic EL element OLED which is a light emitting element, which is the pixel circuit PC illustrated in FIG. 2. The drive circuit according to the embodiment includes five transistors and one capacitor. The organic EL element OLED is a light emitting element that emits a light by allowing a current to flow therein. Among the five transistors illustrated in FIG. 3, three transistors are n-type MOS-TFTs, and two transistors are p-type MOS-TFTs. That is, the organic EL element OLED employs a CMOS circuit. A transistor NTD is a drive transistor for controlling the amount of current flowing into the organic EL element OLED, which is an n-type MOS-FET. A transistor PT1 and a transistor PT2 are a first switching transistor (first switching element) and a second switching transistor (second switching element), respectively, both of which are p-type MOS-TFTs. A transistor NT1 and a transistor NT2 are a third switching transistor (third switching element) and a fourth switching transistor (fourth switching element), respectively, both of which are n-type MOS-TFTs. The organic EL element OLED, the transistor PT1, the transistor NTD, and the transistor PT2 are arranged on a line connected between the first reference voltage $V_S$ and the second reference voltage $V_D$ so as to be connected in series with each other in the stated order from the first reference voltage $V_S$ side. That is, the transistor PT1 is arranged between the organic EL element OLED and the transistor NTD on the line, and the transistor PT2 is arranged on the second reference voltage $V_D$ side of the transistor NTD on the line (arranged between the transistor NTD and a second reference voltage $V_p$). A gate of the transistor PT1 is connected to the first control lines ϕ1, and a gate of the transistor PT2 is connected to the second control lines ϕ2. A capacitor C1 that is a first capacitor is connected between a gate of the transistor NTD and a terminal (in this example, a source) of the transistor PT2 on the second reference voltage $V_D$ side.

The transistor NT1 is connected between the gate and a drain of the transistor NTD. The transistor NT2 is connected between the source of the transistor NTD and the signal line SIG. The gate of the transistor NT1 is connected to the first control lines ϕ1, and the gate of the transistor NT2 is connected to the second control lines ϕ2. A voltage at the drain (drain of the transistor PT2: terminal on the first reference voltage $V_S$ side) of the transistor NTD is a node N1, a voltage at the gate of the transistor NTD is a node N2, and a voltage at the source (source of the transistor PT1: terminal on the second reference voltage $V_D$ side) of the transistor NTD is a node N3.

Figure 4:
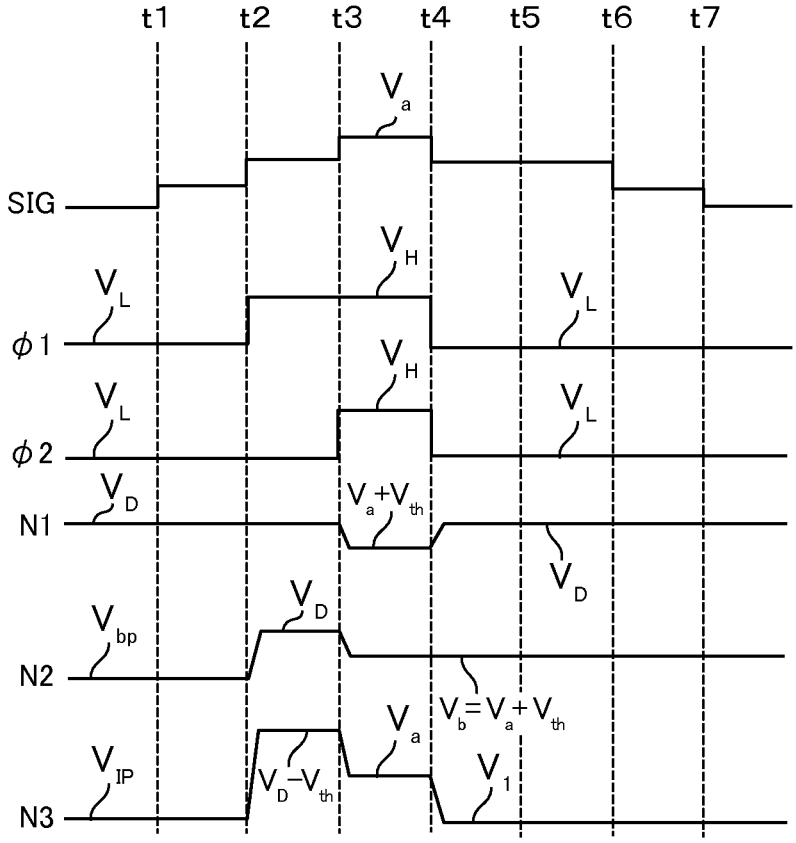
FIG. 4 is a timing chart illustrating a drive method for the drive circuit according to the first embodiment of the present invention.

FIG. 4 is a timing chart illustrating a drive method for the drive circuit according to the embodiment. FIG. 4 illustrates a change in the voltages of the signal lines SIG, the first control lines ϕ1, the second control lines ϕ2, the node N1, the node N2, and the node N3 in time series. When it is assumed that respective times illustrated in FIG. 4 are indicated by times t1 to t7, a period between the time t3 and the time t4 is a signal write period in which a signal voltage $V_a$ corresponding to display data is written into the drive transistor (transistor NTD) provided in the drive circuit, and a period after the time t4 is a light emitting period (display period) in which the organic EL element OLED displays the display data. A period before the time t2 is a first period, which is a light emitting period in which previous display data is displayed, and a period between the time t2 and the time t3 is a second period, which is a reset period in which the voltage written into the drive transistor (transistor NTD) provided in the drive circuit is reset. In FIG. 4, the voltage of the signal line SIG is changed in order, and the respective voltages represent signal voltages of the plural pixel circuits PC (drive circuits) into which the signal is written in order. The plural pixel circuits correspond to the pixel circuits PC aligned in a row in the longitudinal direction of FIG. 3.

Before the time t2 (first period), both of the first control lines ϕ1 and the second control lines ϕ2 are maintained at a low voltage $V_L$. In this example, for the n-type MOS-TFT included in the drive circuit, the low voltage $V_L$ is an off-state voltage, and a high voltage $V_H$ is an on-state voltage. In particular, the high voltage $V_H$ is a voltage as sufficiently high as the n-type MOS-TFT can turn on. Also, for the p-type MOS-TFT included in the drive circuit, the high voltage $V_H$ is an off-state voltage, and the low voltage $V_L$ is an on-state voltage. In particular, the low voltage $V_L$ is a voltage as sufficiently low as the p-type MOS-TFT can turn on. For simplification, absolute values of the threshold voltages of the four switching elements (transistors) included in the drive circuit are equal to each other, and set as a voltage $V_{TH0}$. The high voltage $V_H$ satisfies a relationship of $V_H > V_D + V_{TH0}$ with respect to the second reference voltage $V_D$ and the voltage $V_{TH0}$. It is desirable that the high voltage $V_H$ is sufficiently higher than $V_D + V_{TH0}$. Likewise, the low voltage $V_L$ satisfies a relationship of $V_L < V_S - V_{TH0}$ with respect to the first reference voltage $V_S$ and the voltage $V_{TH0}$. It is desirable that the low voltage $V_L$ is sufficiently lower than $V_S - V_{TH0}$. Both of the first control lines ϕ1 and the second control lines ϕ2 are maintained at the low voltage $V_L$, as a result of which the transistor PT1 and the transistor PT2 are maintained in the on-state before the time t2, and the transistor NT1 and the transistor NT2 are maintained in the off-state. Since the transistor PT2 is sufficiently in the on-state, the node N1 is at the second reference voltage $V_D$. Also, the node N2 is maintained at a voltage $V_{bp}$, and the node N3 is maintained at a voltage $V_{lp}$.

At the time t2 when the reset period (second period) starts, the voltage of the first control lines ϕ1 changes from the low voltage $V_L$ to the high voltage $V_H$. With the above operation, the transistor PT1 becomes in the off-state, and the transistor NT1 becomes in the on-state. In the reset period, the second control lines ϕ2 are maintained at the low voltage $V_L$ so that the transistor PT2 is maintained in the on-state, and the transistor NT2 is maintained in the off-state. The transistor PT1 becomes in the off-state, as a result of which a current supply to the organic EL element OLED is blocked. The transistor NT1 becomes in the on-state, to thereby connect the node N1 and the node N2. The transistor NT1 is sufficiently in the on-state, a current flows into the transistor NT1 in a direction of discharging the capacitor C1, the node N2 becomes equal to the node N1, rises to the second reference voltage $V_D$, and becomes in a stable state. When the node N2 becomes in the stable state, a current flowing in the transistor NT1 is 0. In this example, it is assumed that an absolute value of the threshold voltage of the transistor NTD that is a drive transistor is $V_{th}$. The node N3 rises to $V_D - V_{th}$ while the node N2 rises to the second reference voltage $V_D$.

At the time t3 when the signal write period starts, a voltage of the second control lines ϕ2 changes from the low voltage $V_L$ to the high voltage $V_H$. As a result, the transistor PT2 becomes in the off-state, and the transistor NT2 becomes in the on-state. In the signal write period, the first control lines $\phi 1$ are maintained at the high voltage $V_H$, the transistor PT1 is maintained in the off-state, and the transistor NT1 is maintained in the on-state. The transistor PT2 becomes in the off-state, as a result of which the node N1 is insulated from the second reference voltage $V_D$. At the time t3, the signal voltage $V_a$ corresponding to display data that is displayed by the organic EL element OLED in a subsequent light emitting period is applied to the signal line SIG. Hence, the source of the transistor NTD (node N3) is connected to the signal line SIG, which is at the signal voltage $V_a$, through the transistor NT2 which is in the on-state, and the voltage at the node N3 drops to the signal voltage $V_a$. That is, the transistor NT2 becomes in the on-state in the signal write period, and supplies the signal voltage $V_a$ to the source of the transistor NTD. While the voltage at the node N3 drops to the signal voltage $V_a$, a current flows into the transistor NT1 in a direction of charging the capacitor C1, a voltage at the gate (node N2) of the transistor NTD drops to a voltage of $V_a+V_{th}$, and the gate of the transistor NTD becomes in the stable state. When the gate of the transistor NTD becomes in the stable state, a current flowing into the transistor NT1 is 0. In this example, since the node N1 is connected to the node N2, the voltage at the node N1 becomes $V_a+V_{th}$ as with the node N2. That is, the signal voltage $V_a$ to be applied to the signal line SIG is supplied to the source of the transistor NTD, and along with this operation, the voltage at the gate of the transistor NTD changes to the voltage of $V_a+V_{th}$. In this example, when a maximum value of the signal voltage $V_a$ is $V_{max}$, the second reference voltage $V_D$ needs to be higher than $V_{max}+V_{th}$ which is a maximum value at the node N2 in the signal write period (then, a subsequent light emitting period). That is, there is a need to satisfy $V_D>V_{max}+V_{th}$.

After the signal write period ends, at the time t4 when the light emitting period starts, both of the first control lines $\phi 1$ and the second control lines $\phi 2$ change from the high voltage $V_H$ to the low voltage $V_L$. As a result, both of the transistor PT1 and the transistor PT2 become in the on-state, and both of the transistor NT1 and the transistor NT2 become in the off-state. The transistor NT1 becomes in the off-state, as a result of which the node N2 is insulated from the node N1, and the node N2 becomes a floating node. Also, the transistor NT2 becomes in the off-state, as a result of which the node N3 is insulated from the signal line SIG. Both of the transistor PT1 and the transistor PT2 become in the on-state, as a result of which the second reference voltage $V_D$ and the transistor NTD that is a drive transistor are connected to each other, and the transistor NTD and the organic EL element OLED are connected to each other. With this configuration, the amount of current flowing into the organic EL element OLED is controlled according to a voltage to be applied to the gate of the transistor NTD which is the drive transistor.

In this situation, the source (node N3) of the transistor NTD is at a voltage $V_1$, and the voltage $V_1$ is represented by Expression 1 described below.

$$V_1 \sim V_S + V_{OLED} + V_{PT1} \quad \text{(Ex. 1)}$$

In this example, $V_{OLED}$ is a threshold voltage as a diode of the organic EL element OLED, and $V_{PT1}$ is the amount of voltage drop of the transistor PT1 that is in the on-state due to a resistor (on-resistance).

Also, the gate (node N2) of the transistor NTD is maintained at a voltage $V_b$ due to the voltage across the capacitor C1. A capacitance generated between the source and the gate of the transistor NTD is a capacitance $C_{gs}$. The node N3 that is at the signal voltage $V_a$ in the signal write period changes to the voltage $V_1$ in the light emitting period, as a result of which the voltage $V_b$ at the node N2 is strictly represented by the following Expression 2 with the use of the capacitance $C_{gs}$.

$$V_b \sim V_a + V_{th} - (V_a + V_{th} - V_1) \times \{C_{gs}/(C_{gs}+C1)\} \quad \text{(Ex. 2)}$$

However, for simplification, if it is assumed that the capacitance $C_{gs}$ is sufficiently smaller than the capacitor C1 ($C_{gs} \ll C1$), the voltage $V_b$ is approximated to $V_a+V_{th}$. Hence, as in the signal write period, the voltage $V_b$ at the node N2 is also maintained at $V_b=V_a+V_{th}$ after the time t4.

With the above configuration, a voltage $V_{gs}$ between the source and the gate of the transistor NTD which is the drive transistor is represented by Expression 3 described below.

$$V_{gs} = V_b - V_1 = V_a + V_{th} - V_1 \quad \text{(Ex. 3)}$$

That is, an effective channel voltage $V_{ch}$ of the transistor NTD becomes $V_{ch}=V_a-V_1$ with the subtraction of a threshold voltage $V_{th}$, and the threshold voltage $V_{th}$ of the transistor NTD, and a variation thereof can be corrected.

In the drive circuit according to the present invention, the fourth switching element is connected to the source of the drive transistor, and the fourth switching element that becomes in the on-state in the signal write period supplies the signal voltage to the source of the drive transistor. With a configuration in which the signal voltage is not supplied to the gate of the drive transistor, the voltage to be applied to the gate of the drive transistor can be reset (initialized) with the use of the second reference voltage $V_D$ (power supply to the organic EL element OLED) which is a constant voltage. As a result, the reset power supply can be deleted while the first reference voltage $V_S$ and the second reference voltage $V_D$ are kept at the constant voltage.

In the drive circuit according to the embodiment, the light emitting element can be driven with a simple circuit configuration of the four switching elements and one capacitor in addition to the drive transistor. Further, in the drive method of the drive circuit according to the embodiment, the four switching elements are driven as follows. That is, at the time t2 illustrated in FIG. 4, the first switching element turns off, and the third switching element turns on. At the time t3, the second switching element turns off, and the fourth switching element turns on. At the time t4, the first switching element and the second switching element turn on, and the third switching element and the fourth switching element turn off. Although the drive circuit according to the embodiment can be realized with the simple circuit configuration, the drive of the drive circuit including the correction of the threshold voltage of the drive transistor can be conducted by the above simple drive method.

In particular, in the drive circuit according to the embodiment, the first switching element and the second switching element are each formed of the p-type transistor, and the third switching element and the fourth switching element are each formed of the n-type transistor. Timing at which the first switching element turns on (off), and timing at which the third switching element turns off (on) may coincide with each other. Therefore, the first switching element is configured by the p-type transistor, and the third switching element is configured by the n-type transistor. As a result, a control terminal (gate) of the first switching element, and a control terminal (gate) of the third switching element are connected with the first control line $\phi 1$, and the first switching element and the third switching element can be controlled with the use of the first control line $\phi 1$. Alternatively, the first switching element may be configured by an n-type transistor, and the third switching element may be configured by a p-type transistor. In this case, the voltage of the first control line $\phi 1$ may be opposite in phase to the voltage of the first control lines $\phi 1$ illustrated in FIG. 4. That is, it is desirable that one of the first switching element and the third switching element is the p-type transistor, and the other thereof is the n-type transistor.

The same is applied to the second switching element and the fourth switching element. Since timing at which the second switching element turns on (off), and timing at which the fourth switching element turns off (on) may coincide with each other. Therefore, it is desirable that one of the second switching element and the fourth switching element is the p-type transistor, and the other thereof is the n-type transistor. The control terminal (gate) of the second switching element, and the control terminal (gate) of the fourth switching element are connected with the second control line ϕ2, and the second switching element and the fourth switching element can be controlled with the use of the second control line ϕ2.

In the drive circuit according to the embodiment, the four switching elements can be driven by the two control lines, and a reduction in the number of control lines can be realized. With the reduction in the number of control lines, a circuit scale can be reduced, and the higher definition of the display device can be realized. From the viewpoint of reducing the number of control lines, it is desirable that the first switching element and the third switching element are controlled at the same timing, and the second switching element and the fourth switching element are controlled at the same timing. However, the present invention is not limited to this configuration, but the first switching element and the third switching element may be controlled, independently. Also, the second switching element and the fourth switching element may be controlled, independently.

Second Embodiment

A display device according to a second embodiment of the present invention has the same structure as that of the display device according to the first embodiment except that the configuration of the drive circuit of the light emitting element is different therebetween.

Figure 5:
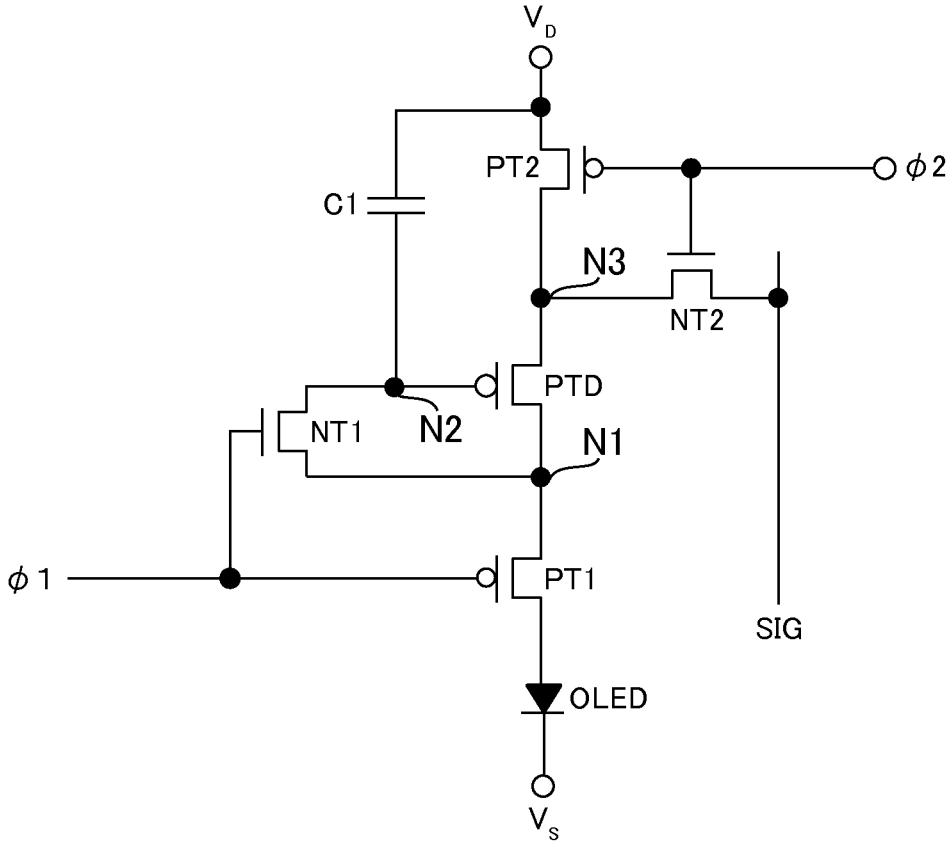
FIG. 5 is a circuit diagram of a drive circuit according to a second embodiment of the present invention.

FIG. 5 is a circuit diagram of a drive circuit according to the embodiment. The drive circuit illustrated in FIG. 5 includes the organic EL element OLED which is a light emitting element, which is the pixel circuit PC illustrated in FIG. 2. Unlike the drive circuit according to the first embodiment illustrated in FIG. 3, a transistor PTD which is a p-type MOS-TFT is used for the drive transistor. The organic EL element OLED, the transistor PT1, the transistor PTD, and the transistor PT2 are arranged on a line connected between a first reference voltage $V_S$ and a second reference voltage $V_D$ so as to be connected in series with each other in the stated order from the first reference voltage $V_S$ side.

Since the transistor PTD is the p-type transistor, a drain of the transistor PTD is a terminal on the first reference voltage $V_S$ side, and connected to the transistor PT1. A source of the transistor PTD is a terminal on the second reference voltage $V_D$ side, and connected to the transistor PT2. For that reason, a node N1 which is a voltage at the drain of the transistor PTD, and a node N3 which is a voltage at the source of the transistor PTD are located upside down as compared with the node N1 and the node N3 illustrated in FIG. 3, respectively. For that reason, an arrangement of the transistor NT1 connected between the gate and the drain of the transistor PTD, and an arrangement of the transistor NT2 connected to the source of the transistor PTD are different from those in the first embodiment. In the drive circuit according to the embodiment, the p-type transistor is used for the drive transistor, and even in this case, the same advantages as those in the first embodiment can be obtained.

A drive method according to the embodiment is identical with that of the first embodiment, and the signal voltage is written under the same control as the voltage changes of the first control lines ϕ1 and the second control lines ϕ2 illustrated in FIG. 4. Because the drive transistor is the p-type transistor, a value of the signal voltage for displaying certain display data is different from that in the first embodiment.

Third Embodiment

A display device according to a third embodiment of the present invention has the same structure as that of the display device according to the first or second embodiment except that the configuration of the drive circuit for the light emitting element is different therebetween.

Figure 6:
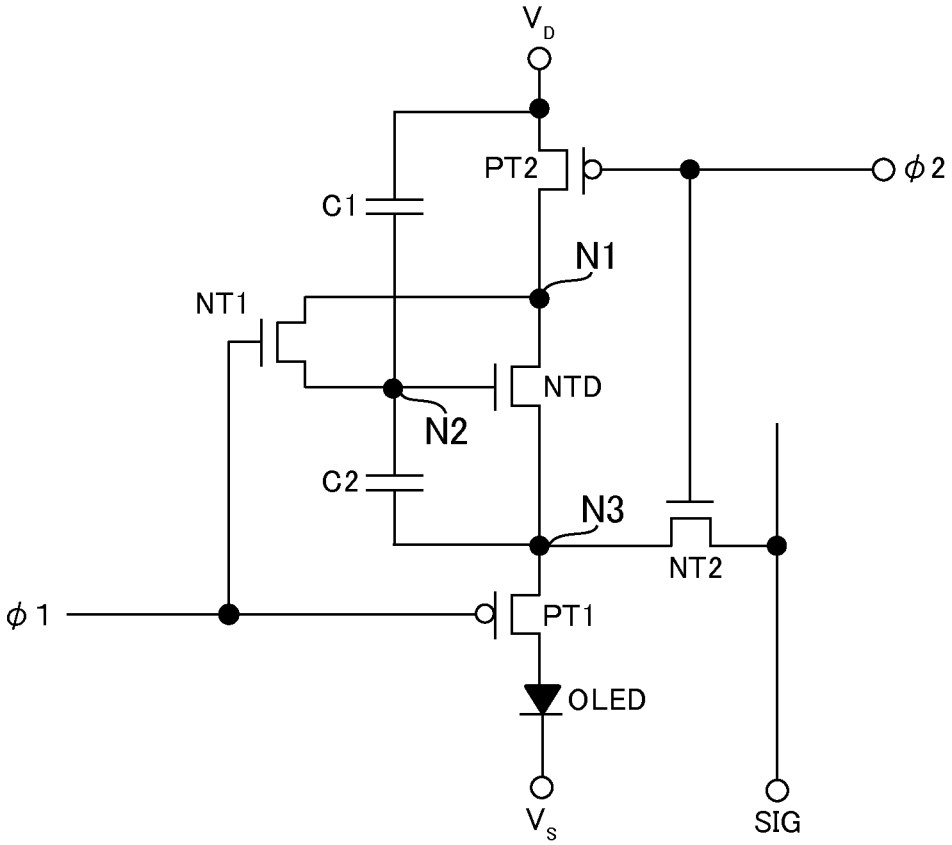
FIG. 6 is a circuit diagram of a drive circuit according to a third embodiment of the present invention.

FIG. 6 is a circuit diagram of a drive circuit according to the embodiment. The drive circuit illustrated in FIG. 6 includes an organic EL element OLED which is a light emitting element, which is the pixel circuit PC illustrated in FIG. 2. The drive circuit according to the embodiment illustrated in FIG. 6 is designed to add a capacitor C2 (second capacitor) connected between a gate and a source (a terminal on the first reference voltage $V_S$ side) to the drive circuit according to the first embodiment illustrated in FIG. 3.

Figure 7:
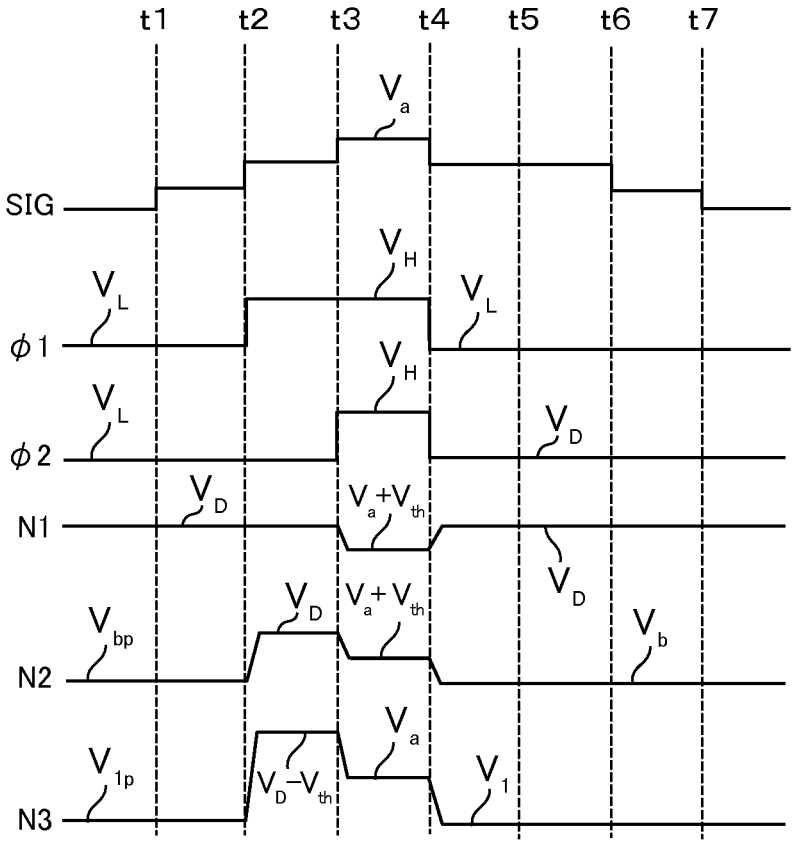
FIG. 7 is a timing chart illustrating a drive method for a drive circuit according to the third embodiment of the present invention.

FIG. 7 is a timing chart illustrating a drive method for the drive circuit according to the embodiment. Likewise FIG. 4, FIG. 7 illustrates a change in voltages of the signal lines SIG, the first control lines ϕ1, the second control lines ϕ2, the node N1, the node N2, and the node N3 in time series. Voltage changes in the first control lines ϕ1 and the second control lines ϕ2 are identical with those in the drive method of the drive circuit according to the first embodiment illustrated in FIG. 4. Also, the voltage changes in the node N1, the node N2, and the node N3 before the time t2 (first period), in a reset period (second period), and in a signal write period are identical with the voltage changes in the node N1, the node N2, and the node N3 according to the first embodiment illustrated in FIG. 4, respectively.

After the signal write period ends, at the time t4 when the light emitting period starts, both of the first control lines ϕ1 and the second control lines ϕ2 change from the high voltage $V_H$ to the low voltage $V_L$. As a result, both of the transistor PT1 and the transistor PT2 become in the on-state, and both of the transistor NT1 and the transistor NT2 become in the off-state. As in the first embodiment, a voltage at a source (node N3) of the transistor NTD becomes a voltage $V_1$ represented by Expression 1. With a change of the node N3 from the voltage $V_a$ to the voltage $V_1$, the gate (node N2) of the transistor NTD changes due to the capacitor C1 and the capacitor C2, and becomes the voltage $V_b$. For simplification, if it is assumed that the capacitance $C_{gs}$ of the transistor NTD is sufficiently smaller than the capacitor C1 (and the capacitor C2) ($C_{gs}$<<C1, $C_{gs}$<<C2) as in the first embodiment, the voltage $V_b$ is represented by Expression 4 described below.

$$V_b \sim V_a + V_{th} - (V_a - V_1) \times \{C2/(C1+C2)\} \quad \text{(Ex. 4)}$$

Expression 4 is organized into Expression 5 described below.

$$V_b \sim V_a \times \{C1/(C1+C2)\} + V_{th} + V_1 \times \{C2/(C1+C2)\} \quad \text{(Ex. 5)}$$

As a result, the voltage $V_{gs}$ between the source and the gate of the transistor NTD that is a drive transistor is represented by Expression 6 described below.

$$V_{gs} = V_b - V_1 = (V_a - V_1) \times \{C1/(C1+C2)\} + V_{th} \quad \text{(Ex. 6)}$$

That is, the effective channel voltage $V_{ch}$ of the transistor NTD is represented by Expression 7 described below with the subtraction of the threshold voltage $V_{th}$.

$$V_{ch} = (V_a - V_1) \times \{C1/(C1+C2)\} \quad \text{(Ex. 7)}$$

Hence, in the drive circuit according to the embodiment, the threshold voltage of the drive transistor (transistor NTD) and the variation thereof can be corrected as in the first embodiment.

Further, in the drive circuit according to the embodiment, as compared with the channel voltage $V_{ch}$ realized by the drive circuit according to the first embodiment, the channel voltage $V_{ch}$ is compressed to {C1/(C1+C2)} times. When the display device is subjected to higher definition, and an area that can be occupied by each of the pixel circuits is reduced, an element size of the transistor NTD that is a drive transistor must be reduced (a channel length L is shortened). In this case, since a current efficiency with respect to a voltage change increases, an available signal voltage range decreases. When a range of the signal voltage supplied from the external (signal line drive circuit XDV) is reduced in association with this phenomenon, gradation voltages corresponding to the number of gradations are allocated to the range. As a result, differences between the adjacent gradation values are reduced to make gradation display difficult. However, in the embodiment, the range of the signal voltage supplied from the external can increase, resulting in such a remarkable advantage that the gradation display is stabilized.

In the drive circuit according to the embodiment, a p-type transistor maybe used for the drive transistor. In this case, the drive circuit according to the embodiment is designed to add the capacitor C2 connected between a gate and a drain (a terminal on the first reference voltage $V_S$ side) of the drive transistor (transistor PTD) to the drive circuit according to the second embodiment illustrated in FIG. 5.

Fourth Embodiment

A display device according to a fourth embodiment of the present invention has the same structure as that of the display device according to anyone of the first to third embodiments except that the configuration of the drive circuit for the light emitting element is different therebetween. Also, the drive method for the light emitting element is identical.

Figure 8:
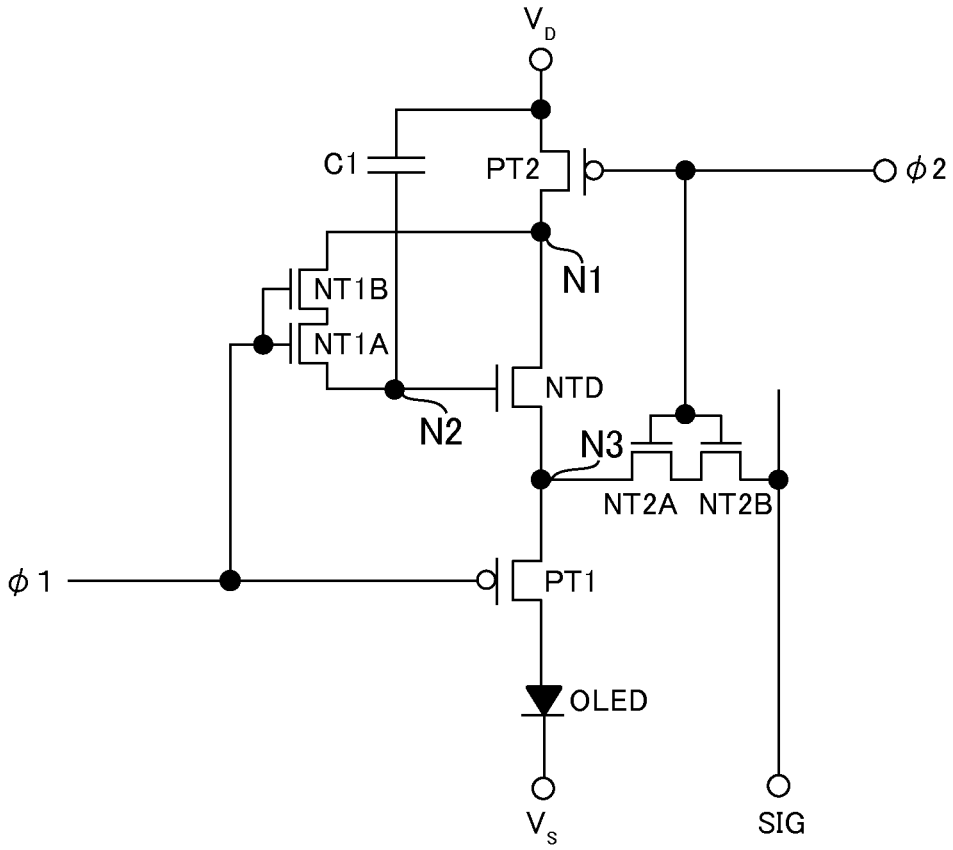
FIG. 8 is a circuit diagram of a drive circuit according to a fourth embodiment of the present invention.

FIG. 8 is a circuit diagram of a drive circuit according to the embodiment. The drive circuit according to the first embodiment illustrated in FIG. 3 includes a transistor NT1 as a third switching element, and a transistor NT2 as a fourth switching element. On the contrary, in the drive circuit according to the embodiment, the third switching element and the fourth switching element are each configured by a transistor having a multi-gate structure. In the embodiment, as an example of the transistor having the multi-gate structure, a thin-film transistor having a double gate structure is used for each of the third switching element and the fourth switching element. FIG. 8 illustrates two transistors NT1A and NT1B connected in series with each other as the third switching element, and two transistors NT2A and NT2B connected in series with each other as the fourth switching element. The drive circuit according to the embodiment is identical in the other configurations with the drive circuit according to the first embodiment.

Now, let us consider the drive circuit according to the first embodiment illustrated in FIG. 3. In the light emitting period, the transistor NT1 is in the off-state, and the node N2 is insulated from the node N1 into a floating node. Also, the transistor NT2 is in the off-state, and the node N3 is insulated from the signal lines SIG. When a leak current flows into the transistor NT1, a voltage at the node N2 (the gate of the transistor NTD) changes with the result that a display quality is degraded. Also, when a leak current flows into the transistor NT2, a voltage at the node N3 (the source of the transistor NTD) changes with the result that the display quality is degraded likewise. In particular, if the transistor NT1 and the transistor NT2 are each formed of a low-temperature polysilicon TFT, the leak current is problematic. On the contrary, in the drive circuit according to the embodiment, the third switching element and the fourth switching element are each configured by a thin-film transistor having the double gate structure, to thereby suppress the leak current in the light emitting period. This leads to such significant advantages that the stabilization of the current control of the transistor NTD can be realized, and a poor image quality such as smear can be reduced.

From the viewpoint of the reduction in the leak current, it is desirable that the third switching element and the fourth switching element are each configured by a transistor having the multi-gate structure. However, any one of the third switching element and the fourth switching element may be configured by the transistor having the multi-gate structure. The switching element has the advantage that the reduction in the leak current is realized.

The drive circuit illustrated in FIG. 8 is configured to replace the third switching element and the fourth switching element in the drive circuit according to the first embodiment illustrated in FIG. 3 with the transistors having the multi-gate structure. However, the present invention is not limited to this configuration. The third switching element and the fourth switching element in the drive circuit according to the second or third embodiment may be each replaced with the transistor having the multi-gate structure. Also, any one of the third switching element and the fourth switching element may be replaced with the transistor having the multi-gate structure. This drive circuit also has such an advantage that the reduction in the leak current is realized.

Figure 9:
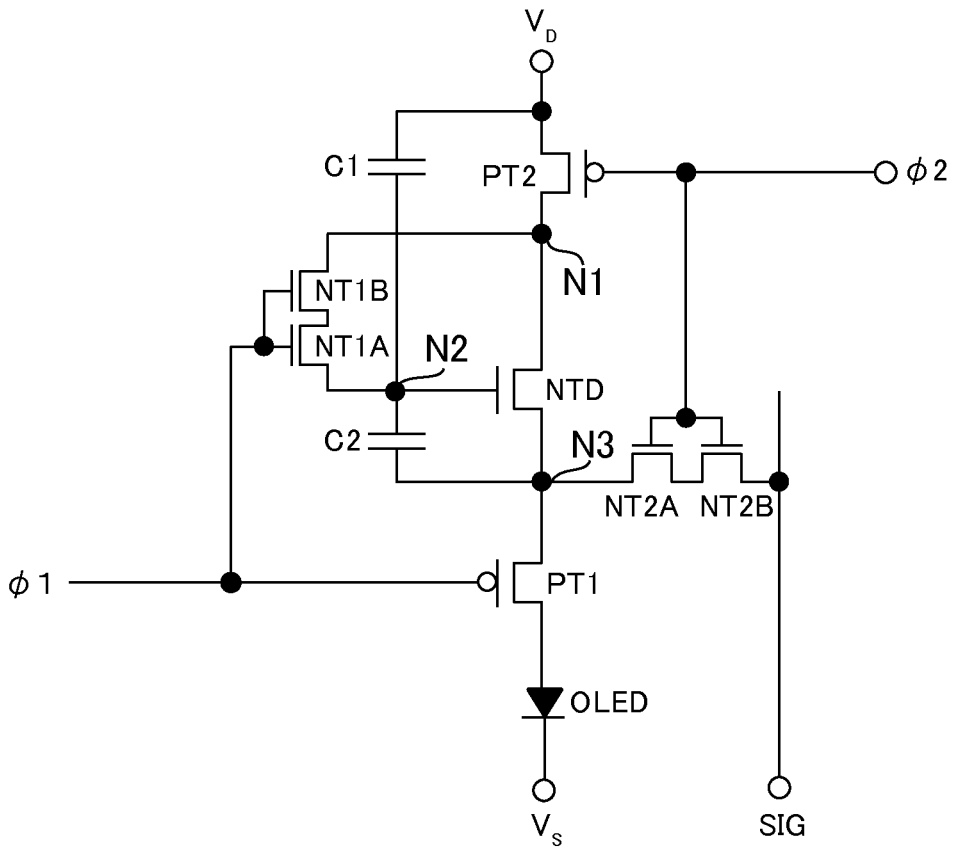
FIG. 9 is a circuit diagram of a drive circuit according to another example of the fourth embodiment of the present invention.

FIG. 9 is a circuit diagram of a drive circuit according to another example of the embodiment. The drive circuit illustrated in FIG. 9 is configured to replace the third switching element and the fourth switching element in the drive circuit according to the third embodiment illustrated in FIG. 6 with the transistors having the multi-gate structure. Also, although not shown, the same is applied to the drive circuit using the p-type transistor for the drive transistor in the drive circuit according to the second embodiment illustrated in FIG. 5, or in the drive circuit according to the third embodiment.

Fifth Embodiment

A display device according to a fifth embodiment of the present invention has the same structure as that of the display device according to the fourth embodiment except that the configuration of the drive circuit for the light emitting element is different therebetween.

Figure 10:
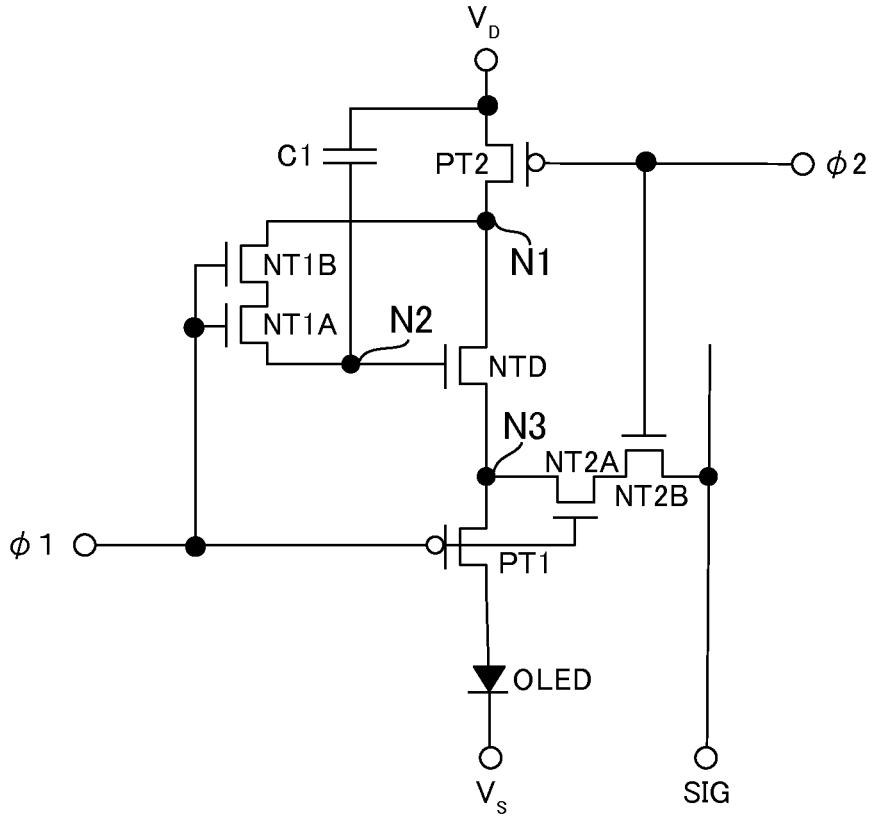
FIG. 10 is a circuit diagram of a drive circuit according to a fifth embodiment of the present invention.

FIG. 10 is a circuit diagram of a drive circuit according to the embodiment. The drive circuit according to the fourth embodiment illustrated in FIG. 8 includes the transistor NT2A and the transistor NT2B connected in series with each other as the fourth switching element. Both of the gates of the transistor NT2A and the transistor NT2B are connected to the second control line $\phi$2. On the contrary, in the drive circuit according to the embodiment, the gate of the transistor NT2A in those two transistors is connected to the first control lines $\phi$1. The drive circuit according to the embodiment is identical in the other configurations with the drive circuit according to the fourth embodiment illustrated in FIG. 8.

The drive method for the drive circuit according to the embodiment is identical with the drive methods illustrated in FIGS. 4 and 7. The first control lines $\phi$1 become high voltage $V_H$ in a period of the time t2 to time t4, and become low voltage $V_L$ in the other periods. The second control lines $\phi$2 become high voltage $V_H$ in a period of the time t3 to time t4, and become low voltage $V_L$ in the other periods. The fourth switching element becomes in the on-state when both of the transistor NT2A and the transistor NT2B connected in series with each other are in the on-state, that is, in the period of the time t3 to the time t4. Also, in the other periods, the fourth switching element becomes in the off-state.

Also, the drive circuit according to the embodiment has such an advantage that the reduction in the leak current is realized as in the drive circuit according to the fourth embodiment. Further, the drive circuit according to the embodiment has such significant advantages that the degree of freedom of design increases to enable an arrangement useful in the high-definition pixel layout. The drive circuit illustrated in FIG. 10 is configured to change a connection destination of the gate of the transistor NT2A in the drive circuit according to the fourth embodiment illustrated in FIG. 8 changes from the second control line ϕ2 to the first control line ϕ1. However, the present invention is not limited to this configuration.

Figure 11:
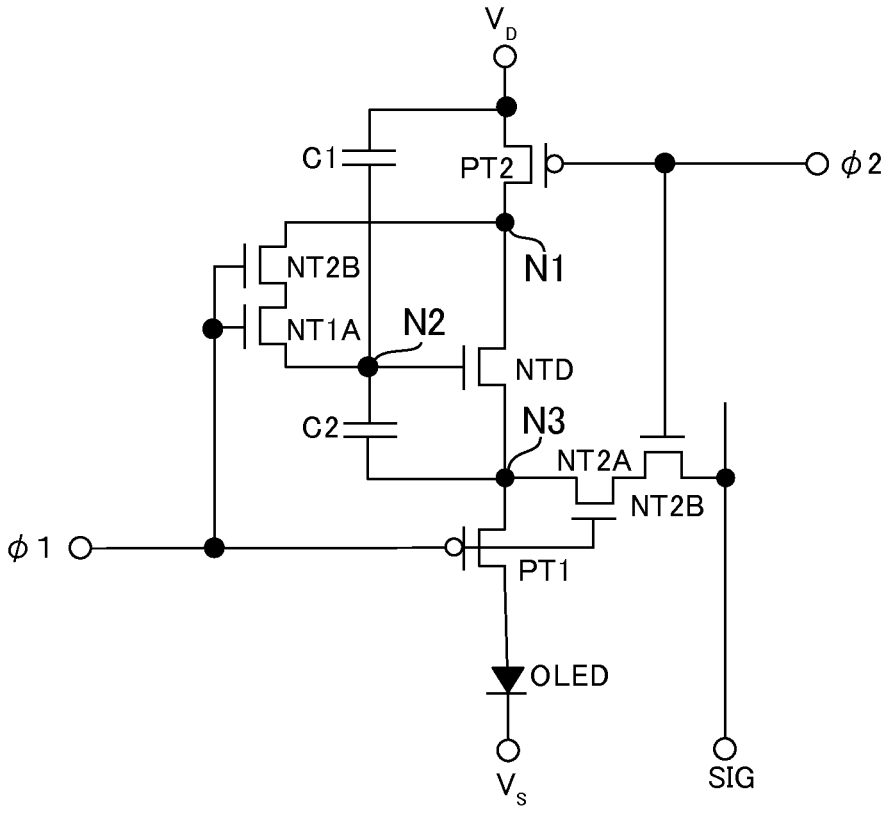
FIG. 11 is a circuit diagram of a drive circuit according to another example of the fifth embodiment of the present invention.

FIG. 11 is a circuit diagram of a drive circuit according to another example of the embodiment. The drive circuit illustrated in FIG. 11 is configured to change a connection destination of the gate of the transistor NT2A in the drive circuit according to the fourth embodiment illustrated in FIG. 9 to the first control line ϕ1, and has such a significant advantage that an arrangement useful in the high definition pixel layout is enabled. Also, although not shown, the same is applied to the drive circuit using a p-type transistor for the drive transistor.

The drive circuit, the display device, and the drive method according to the embodiments of the present invention have been described above. In the above embodiments, when the drive transistor is the n-type MOS-FET (transistor NTD) or the p-type MOS-FET (transistor PTD), the third switching element (transistor NT1) is connected between the gate and the drain of the drive transistor. The source and the drain of the transistor according to the above embodiments are consistently determined according to a potential relationship of the respective portions in the display drive operation. For example, a case in which the potential relationship of the source and the drain is reversed in periods other than the display drive operation is interpreted without departing from the technical scope of the present invention. Also, in the above embodiments, the first capacitor (capacitor C1) is connected between the gate of the drive transistor and the second reference voltage VD. However, the connection to the first capacitor is not limited to the second reference voltage VD, but may be connected to a constant voltage.

With the application of the CMOS circuit, the transistor provided in the drive circuit is limited to the p-type MOS-TFT or the n-type MOS-TFT. However, the present invention is not limited to this configuration, but another transistor may be applied, or another switching element may be applied. In the embodiment, the organic EL element OLED has been described as an example of the light emitting element, but may not be limited to this configuration. The drive circuit according to the present invention can be extensively applied to the drive circuit for the light emitting element having the amount of light emission controlled according to the amount of flowing current. With the provision of the drive circuit according to the present invention in the display device, a reduction in the size of the display device which copes with the higher definition is realized. However, the drive circuit according to the present invention is not limited to the display device, but can be applied to another device.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A drive circuit, comprising:
a first line that is connected to a first reference voltage;
a second line that is connected to a second reference voltage higher than the first reference voltage;
a light emitting element that is arranged between the first line and the second line, and emits a light by allowing a current to flow therein;
a drive transistor that is arranged between the light emitting element and the second line, for controlling the amount of current flowing into the light emitting element;
a first switching element that is arranged between the light emitting element and the drive transistor;
a second switching element that is arranged between the drive transistor and the second line;
a third switching element that is arranged between a gate of the drive transistor, and one of a source and a drain of the drive transistor;
a fourth switching element that is connected to another of the source and the drain of the drive transistor, and controls an input of a signal voltage;
a first capacitor having one end connected to the gate of the drive transistor; and
a second capacitor that is arranged between the gate of the drive transistor and a terminal on the first line side out of the source and the drain of the drive transistor.

2. A drive circuit according to claim 1,
wherein one of the first switching element and the third switching element is a p-type transistor, and another thereof is an n-type transistor.

3. A drive circuit according to claim 1,
wherein one of the second switching element and the fourth switching element is a p-type transistor, and another thereof is an n-type transistor.

4. A drive circuit according to claim 1,
wherein a gate of the first switching element and a gate of the third switching element are connected to a first control line.

5. A drive circuit according to claim 1,
wherein a gate of the second switching element and a gate of the fourth switching element are connected to a second control line.

6. A drive circuit according to claim 1,
wherein the third switching element comprises a transistor having a multi-gate structure.

7. A drive circuit according to claim 1,
wherein the fourth switching element comprises a transistor having a multi-gate structure.

8. A display device comprising a display unit in which a plurality of the drive circuits according to claim 1 are arrayed.

9. A drive circuit according to claim 1,
wherein the first capacitor has another end connected to a constant voltage.

10. A drive circuit according to claim 9,
wherein the first capacitor has the other end connected to the second reference voltage.

11. A drive method for a drive circuit including:
a first line that is connected to a first reference voltage;
a second line that is connected to a second reference voltage higher than the first reference voltage;
a light emitting element that is arranged between the first line and the second line, and emits a light by allowing a current to flow therein;

a drive transistor that is arranged between the light emitting element and the second line, for controlling the amount of current flowing into the light emitting element;

a first switching element that is arranged between the light emitting element and the drive transistor;

a second switching element that is arranged between the drive transistor and the second line;

a third switching element that is arranged between a gate of the drive transistor, and one of a source and a drain of the drive transistor;

a fourth switching element that is connected between to another of the source and the drain of the drive transistor, and controls an input of a signal voltage;

a first capacitor having one end connected to the gate of the drive transistor;

a second capacitor that is arranged between the gate of the drive transistor, and a terminal on the first line side out of the source and the drain of the drive transistor, the drive method comprising:

resetting the drive transistor by supplying a reset voltage to the gate of the drive transistor in a reset period in which the first switching element and the fourth switching element are in an off-state, the second switching element and the third switching element are in an on-state.

12. A drive method for the drive circuit according to claim 11, the drive method further comprising:

writing a display signal to the drive circuit by supplying the signal voltage to the other of the source and the drain of the drive transistor in a signal write period in which the first switching element and the second switching element are in the off-state, the third switching element and the third switching element are in the on-state.

13. A drive method for the drive circuit according to claim 11, wherein the first switching element and the third switching element are controlled by a first control line and operate exclusively each other, and the second switching element and the fourth switching element are controlled by a second control line and operate exclusively each other.

* * * * *